US006255922B1

(12) United States Patent
Malmström et al.

(10) Patent No.: US 6,255,922 B1
(45) Date of Patent: Jul. 3, 2001

(54) MICROWAVE RESONATOR WITH DIELECTRIC TUNING BODY RESILIENTLY SECURED TO A MOVABLE ROD BY SPRING MEANS

(75) Inventors: Jan Malmström, Saltsjö-Boo; Jan Sjöholm; Joakim Ostin, both of Stockholm, all of (SE)

(73) Assignee: Allogon AB, Akersberga (SE)

( * ) Notice: Subject to any disclaimer, the term of this patent is extended or adjusted under 35 U.S.C. 154(b) by 0 days.

(21) Appl. No.: 09/424,859

(22) PCT Filed: May 18, 1998

(86) PCT No.: PCT/SE98/00932

§ 371 Date: Jan. 12, 2000

§ 102(e) Date: Jan. 12, 2000

(87) PCT Pub. No.: WO98/56062

PCT Pub. Date: Dec. 10, 1998

(30) Foreign Application Priority Data

Jun. 6, 1997 (SE) ..... 9702178

(51) Int. Cl.[7] ..... H01P 7/10; H01P 7/00

(52) U.S. Cl. ..... 333/219.1; 333/234; 333/235

(58) Field of Search ..... 333/219.1, 219, 333/231, 224, 226, 232, 234, 235

(56) References Cited

U.S. PATENT DOCUMENTS

| | | | | |
|---|---|---|---|---|
| 2,103,515 | | 12/1937 | Conklin et al. | 178/44 |
| 4,661,790 | | 4/1987 | Gannon et al. | 333/234 |
| 4,728,913 | | 3/1988 | Ishikawa et al. | 333/235 |
| 5,039,966 | | 8/1991 | Schmid et al. | 333/229 |
| 5,105,158 | | 4/1992 | Fiedziuszko | 324/693 |
| 5,345,203 | * | 9/1994 | Gentsch et al. | 333/219.1 |
| 5,440,281 | * | 8/1995 | Wey et al. | 333/126 |
| 5,612,655 | | 3/1997 | Stronks et al. | 333/202 |

FOREIGN PATENT DOCUMENTS 1561442 2/1980 (GB) .

OTHER PUBLICATIONS

Patent Abstracts of Japan, JP 8–293710 A (Yagi Antenna Co Ltd), Nov. 5, 1996.

* cited by examiner

*Primary Examiner*—Robert Pascal
*Assistant Examiner*—Patricia Nguyen
(74) *Attorney, Agent, or Firm*—Jacobson Holman PLLC

(57) ABSTRACT

A microwave resonator comprising a cavity (7) with a dielectric resonator device (8, 11) including a movable dielectric tuning body (11), which is mechanically coupled to an electrical motor (28). The tuning body is carried by an electrically nonconductive rod (12, 13) which is provided with a resiliently biassed (19) clamping element (15) adapted to clamp the plunger (11) against a stop means (14) on the rod.

19 Claims, 1 Drawing Sheet

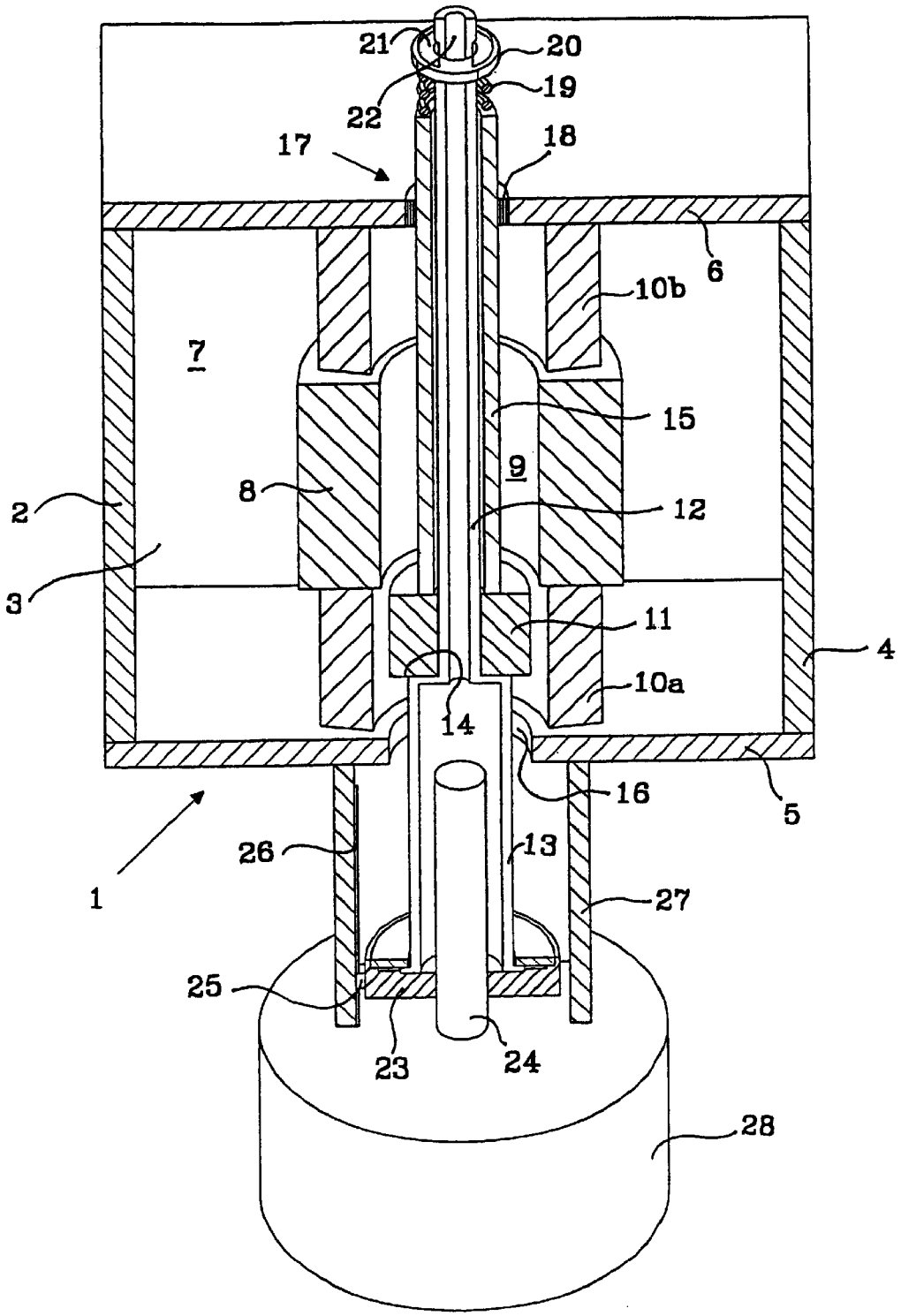
21
20
19
22
17
18
6
10b
7
15
9
8
12
2
3
11
4
10a
14
16
5
1
26
13
27
25
23
24
28

MICROWAVE RESONATOR WITH DIELECTRIC TUNING BODY RESILIENTLY SECURED TO A MOVABLE ROD BY SPRING MEANS

The invention relates to a microwave resonator, comprising a substantially closed housing defining a cavity and a dielectric resonator device disposed in said cavity, said dielectric resonator device including a movable dielectric tuning body, which is mechanically coupled to an external actuator via a rod for displacement inside said cavity so as to control the resonant frequency of the resonator.

Such resonators are frequently used nowadays in microwave filters, combiners and the like. When using a dielectric resonator device in a cavity, the major part of the electromagnetic field will be concentrated to the region of the dielectric resonator device. Therefore, the dielectric material, and any other material adjacent thereto, will be heated due to power dissipation.

The document U.S. Pat. No. 4,661,790 discloses a filter including a ceramic device in a resonator cavity, wherein a ceramic tuning body is displaceable in order to adjust the resonance frequency of the filter and also to compensate for different thermal expansion of the various components thereof. The rod, which carries the tuning body, is made of a metal material, in particular copper-plated nickel steel ("INVAR"), and protrudes a small distance into the cavity.

Such a metal rod protruding into the cavity will inevitably give rise to power losses because of a strong interaction between the resonating electro-magnetic field and the metal material.

Accordingly, the main object of the present invention is to solve this problem and to provide a microwave resonator, which will secure low power losses while enabling a secure, permanent and well-defined connection between the movable rod and the tuning body, even after long use at strongly varying temperatures.

A complicating factor is that metal fittings for securing the tuning body on the rod cannot be used, since they would influence the electro-magnetic field and be excessively heated. Moreover, it is difficult to find a glue or some other permanently adhesive material, which would hold the tuning body on the rod without ageing or losing its adhesive properties upon being heated.

The stated main object is achieved in that the rod is made of an electrically non-conductive material and is provided with a resiliently biassed clamping element adapted to clamp the dielectric tuning body against a stop means on the rod. Then, the tuning body will be exactly positioned at the stop means so long as the clamping means exerts a biassing force on the tuning body.

The resiliently biassed clamping element will hold the tuning body in a well-defined position, even if the clamping element and/or the rod would expand or contract due to thermal variations. Furthermore the clamping action can be maintained even after long use, since there is no need for fasteners or adhesives which are subject to ageing or become ineffective at varying temperatures.

The rod may be displaceable by a translatory or rotary motion. Likewise, the biassing force may be exerted axially, i.e. in parallel to the axis of the rod, or in a rotational direction.

The stop means is preferably a shoulder surface between first and second portions of the rod having different diameters. The tuning body may then be formed as a ring element, which is located externally on the rod portion having the smallest diameter. Alternatively, the rod is tubular at its wider portion, in which case the tuning body is located inside the tubular portion next to the shoulder forming a transition to a narrower portion of the rod. This narrow portion may be tubular or massive.

According to an advantageous embodiment, the clamping element is biassed by a spring arranged on a portion of the rod being located outside the cavity. In such a case, the spring may be made of steel, whereas the clamping element, which is normally elongated and reaches into the cavity, may be made of an electrically non-conductive, heat resistant material, e.g. aluminium oxide, which has the additional advantage of being somewhat heat conductive so as to lead away some of the heat generated in the tuning body.

Preferably, the movable rod, which carries the tuning body, extends through the whole cavity and through holes in opposite wall portions thereof. One end portion may then be coupled to an external motor, e.g. by threaded engagement with the rotating motor shaft, whereas the other end portion, outside the cavity, is provided with a spring. Most preferably, the spring acts on a clamping element in the form of a sleeve, which in turn exerts a biassing axial force on the tuning body, the latter being formed as a ring element, e.g. of ceramic material.

These and other features are stated in the claims and will also be apparent from the detailed description below.

The invention will thus be explained further below with reference to the enclosed drawing, which illustrates a preferred embodiment.

The only drawing figure shows schematically a perspective view, partially cut away to show the inside, of a resonator cavity provided with a tuning device according to the invention.

On the drawing, many details not related to the inventive concept have been left out, such as joints, sealing elements, input and output terminal devices for the microwave carrier wave, etc.

A box-like housing 1 includes four side walls, three of which are visible in the drawing, namely those denoted 2, 3 and 4 a lower wall 5 and an upper wall 6, so as to form a parallelepipedic box defining an interior cavity 7, which serves a resonator for a microwave carrier wave to be transferred between a transmitter/receiver and an antenna, in particular as a part of a combiner including a number of similar resonator cavities.

The cavity 7 comprises a centrally located resonator body 8, being made of ceramic material and having an annular shape with a central, axial hole 9 and being held in a fixed position by two coaxially arranged support sleeves 10*a*, 10*b*. The latter are secured to the lower and upper walls 5, 6, respectively. The fixed ceramic body 8 and the interior surfaces of the walls 2, 3, 4, 5 and 6 will provide a resonator cavity having a certain resonance frequency. The latter can be tuned to a desired value by means of a relatively small tuning body 11, likewise of ceramic material, which is movable along, a linear path passing through the central hole 9 of the annular ceramic body 8. The resonance frequency will thus depend on the axial position of the tuning body 11.

The present invention concerns the mechanical support and controllable positioning of the tuning body 11. In the preferred embodiment, the tuning body 11 is shaped as a ring element which is slid onto a relatively narrow portion 12 of a rod made of quartz glass. The rod is tubular and has a wider lower portion 13 which defines a shoulder 14 serving as a stop surface for the tuning body 11. The tuning body 11 is constantly pressed against the shoulder 14 by means of an elongated, relatively narrow sleeve 15, serving as a clamping element. The sleeve 15 is made of a material with low losses from a radio-frequent electromagnetic field and yet having the capability of conducting some of the heat generated in the ceramic elements 8 and 11, e.g. aluminium oxide.

The wide portion 13 of the rod extends freely through a hole 16 in the lower wall 5, whereas the sleeve 15 passes freely through an oppositely located hole 17, provided with a guiding bushing 18, in the upper wall 6. Thus, both the narrow rod portion 12 and the surrounding sleeve 15 extend to the outside of the top wall 6. In this outside region, a helical spring 19 acts between the axial end of the sleeve 15 and a washer 20, which is retained by a locking element 21 engaging with a circumferential groove 22 at the end portion of the rod.

In this way, the clamping sleeve 15 is pressed axially by the pressure spring 19 so as to exert a substantially constant force on the tuning body 11, which is consequently clamped against the shoulder 14 on the rod 12, 13.

At the lower side (as seen on the drawing) of the housing 1, the wide portion 13 of the tubular rod is provided with an internally threaded element, such as a nut 23, which engages with the externally threaded rotatable output shaft 24 of an electric step motor 28. The nut 23 is axially secured to the rod portion 13 and is held against rotation by means of a radially projecting pin 25 which is guided in a linear slot 26 extending axially in an external holding sleeve 27, which holds the electric motor in a fixed position in relation to the housing 1.

Upon actuating the electric step motor 28, the shaft 24 will rotate and the rod 12, 13 will consequently be linearly displaced in an axial direction, i.e. upwards or downwards as seen in the drawing, whereby the tuning body 11 is displaced so as to tune the microwave resonator into a desired resonance frequency.

The inventive arrangement may be modified by those skilled in the art, within the scope defined in claim 1. For example, the fixed and movable ceramic elements 8 and 11 do not have to be concentric but may be arranged side by side, the tuning body being movable along a linear path in parallel to the axial extension of the fixed ceramic body. Alternatively, the tuning body may be rotatable in relation to the fixed ceramic body.

The stop means does not have to be a shoulder between two rod parts having different diameters. Instead it may be formed as an annular flange externally on a massive rod or internally in a tubular rod. In the latter case, the clamping element would be a central rod element located inside the tubular rod.

The rod may comprise two or more parts being joined together, in particular in the form of longitudinal segments, each being massive or tubular.

The external actuator may be a mechanical device, e.g. operated manually.

What is claimed is:

1. A microwave resonator, comprising a substantially closed housing defining a cavity and a dielectric resonator device disposed in said cavity, said dielectric resonator device including a movable dielectric tuning body, which is mechanically coupled to an external actuator via a rod for displacement inside said cavity so as to control the resonant frequency of the resonator, where said rod contains a stop means and is made of an electronically non-conductive material wherein said rod is provided with a resilient biassed clamping element, biassed by a spring means, said spring means is located outside said-cavity, where said clamping element is adapted to clamp the dielectric tuning body against said stop means on the rod.

2. The microwave resonator as defined in claim 1, wherein said rod is displaceable linearly.

3. The microwave resonator as defined in claim 1, wherein said clamping element is axially biassed.

4. The microwave resonator as defined in claim 3, wherein said stop means is a shoulder surface extending between first and second portions of said rod having different diameters.

5. The microwave resonator as defined in claim 1, wherein said rod, with said tuning body, is movable relative to a dielectric resonator body, which is held in a fixed position in said cavity by electrically non-conductive supporting means.

6. The microwave resonator as defined in claim 5, wherein said rod is movable inside a central opening in said dielectric resonator body.

7. The microwave resonator as defined in claim 1, wherein said spring means is arranged on a portion of said rod being located outside said cavity.

8. The microwave resonator as defined in claim 7, wherein said rod extends through openings in two opposite wall portions of said housing.

9. The microwave resonator as defined in claim 8, wherein a first end portion of said through-going rod is connected to said external actuator, and a second, opposite end portion of said through-going rod is provided with said spring means.

10. The microwave resonator as defined in claim 9, wherein said tuning body is a ring element and said clamping element is a sleeve enclosing said rod, said sleeve also extending through one of said openings, and said spring means acting between said second end portion of said rod and a corresponding end portion of said sleeve.

11. The microwave resonator as defined in claim 10, wherein said spring means acts between a locking member retained in a circumferential groove in said rod and an end surface of said sleeve (15).

12. The microwave resonator as defined in claim 7, wherein said spring means is made of steel.

13. The microwave resonator as defined in claim 1, wherein said rod is made of quartz glass.

14. The microwave resonator as defined in claim 1, wherein said clamping means is made of an electrically non-conductive low loss material.

15. The microwave resonator as defined in claim 14, wherein said low loss material is a heat conductive material.

16. The microwave resonator as defined in claim 15, wherein said low loss material is aluminium oxide.

17. The microwave resonator as defined in claim 1, wherein said dielectric resonator device comprises at least one body made of a ceramic material.

18. The microwave resonator as defined in claim 1, wherein said external actuator comprises an electrical motor.

19. The microwave resonator as defined in claim 18, wherein said electrical motor has a rotatable output shaft, which is coupled to said rod by means of a threaded member so as to impart a linear movement to said rod.

* * * * *